United States Patent [19]

Güttinger

[11] Patent Number: 4,990,072

[45] Date of Patent: Feb. 5, 1991

[54] ROTATING HELICAL CHARGER WITH AXIALLY MOVABLE DISPLACEMENT DISK

[75] Inventor: Frank Güttinger, Oberehrendingen, Switzerland

[73] Assignee: Aginfor AG fur Industrielle Forschung, Wettingen, Switzerland

[21] Appl. No.: 380,886

[22] Filed: Jul. 18, 1989

[30] Foreign Application Priority Data

Jul. 20, 1988 [CH] Switzerland ..... 2786/88

[51] Int. Cl.[5] ..... F04C 18/04; F04C 27/00

[52] U.S. Cl. ..... 418/55.3; 418/55.4; 418/55.5; 418/57; 418/188

[58] Field of Search ..... 418/55 B, 55 C, 55 D, 418/57, 188

[56] References Cited

U.S. PATENT DOCUMENTS 3,600,114 8/1971 Dvorak et al. ..... 418/55 D
4,610,610 9/1986 Blain ..... 418/55 D

FOREIGN PATENT DOCUMENTS 61-8488 1/1986 Japan ..... 418/55 B
63-173870 7/1988 Japan ..... 418/188

*Primary Examiner*—John J. Vrablik
*Attorney, Agent, or Firm*—Burns, Doane, Swecker & Mathis

[57] ABSTRACT

A rotating helical charger for compressible media consists essentially of a housing (1), in which two symmetrically constructed displacement disk (6, 7) are rotated by drive elements (18–23). The two displacement disks are equipped on one side with helical ribs (14). To form a conveying space (15), the ribs engage each other and seal with their free frontal sides (24) against the opposing displacement disk. To maintain the sealing effect, a pressure chamber (26) is provided, which communicates with the outlet (16) of the charger and may be acted upon by an axially displaceable annular disk (28), actively connected with an axially movable displacement disk (6). The pressure chamber (26) may be connected by means of a valve (32) with the atmosphere.

3 Claims, 2 Drawing Sheets

ROTATING HELICAL CHARGER WITH AXIALLY MOVABLE DISPLACEMENT

BACKGROUND OF THE INVENTION

1. Field of Invention

The invention concerns a rotating helical charger for compressible media.

2. Description of Related Art

A helical charger with rotating displacement disks is disclosed in FIG. 5 of U.S. Pat. No. 3,989,422. The disclosed helical charger is characterized by conveying a gaseous working medium, comprising, for example, air on an air-fuel mixture, almost without pulsation, and can therefore be used advantageously for the charging of internal combustion engines. In the disclosed compressor, several approximately sickle shaped work spaces are arranged between helical ribs. During operation of the compressor, the spaces move from an inlet to an outlet, while their volume is constantly reduced and the pressure of the working medium correspondingly increased. In these helical chargers the quantity moved at a given volumetric compressor efficiency, together with the maximum charging pressure, are determined by the drive gear ratio, as the internal pressure ratio is fixedly determined by the helical geometry selected. If a rigid driving connection is provided between the helical compressor and the driving internal combustion engine, the charger will charge even in operating states in which charging is not required, for example under a partial load or even during idling. This could lead to a loss of efficiency and possibly to unfavorable increases in temperature, if the working medium being conveyed is expanded and returned to the inlet of the charger.

In contrast to the aforementioned charger, in a charger disclosed by U.S. Pat. No. 3,600,114, only one displacement disk is mounted on an axle journal. The second disk is connected fixedly in rotation with a drive shaft. During the rotation of the first disk, the second disk is entrained in the same rotating direction and at the same rotating velocity. In the process, the disks perform a relative motion in the form of a circular displacement.

In FIGS. 8 and 9, of U.S. Pat. No. 3,600,114, a two-speed, single stage machine is disclosed in which the two mobile displacement disks are mounted loosely on stationary eccentric axles. One of the axles is hollow so that the working medium may be passed out of the machine. At their circumference the displacement disks are provided with gear rims, engaged by a common toothed gear mounted on a drive shaft.

These multiple speed machines have the advantage that each of the displacement disks are completely balanced individually and that a more uniform conveyance almost without pulsation is possible. In addition, the radial displacement, and thus the eccentricity, between the two rotating axes is smaller than with single speed machines, resulting in lower sliding velocities between the helical ribs. In principal therefore, higher rpm's may be obtained with this type of charger.

Another variant of this working principle is shown in FIG. 5 and 6 of the aforecited reference. In this machine one of the disks is again connected with a central drive shaft. In the course of the rotation this one disk, the second disk is entrained in the same direction of rotation by means of force transfer by the helical ribs. In order to equalize the axial pressure between the work spaces created between the disks, an axially mobile annular disk tightly abutting against the rear side of one of the disks is provided. Through a pressure equalizing chamber connected with the machine outlet and by means of a flat spring, the annular disk presses the two displacement disks together. The disadvantage of this arrangement consists of the fact that the annular disk must be sealed against the housing, which may be effected at the outer circumference with a large diameter and thus high sliding velocities. Furthermore, no measure is provided to relieve the pressure equalizing chamber located between the annular disk and the housing. However, such a measure would be meaningless, as the flat spring applies a constant pressure.

SUMMARY OF THE INVENTION

It is an object of the present invention to provide a helical charger of the above-mentioned type that may be deactivated, i.e., to at least extensively discontinue the conveyance of the working medium.

This object is attained according to the present invention by connecting the pressure chamber with the atmosphere by means of a valve.

In this manner a simple means is provided to relieve the pressure chamber through an operating parameter or a process parameter, whereupon the axial pressure eliminates the sealing effect within the conveying space, thereby discontinuing the conveying process.

It is particularly appropriate to have the annular disk seal inside the housing at its external diameter with a bellows against the housing and to separate the inlet from the outlet by a lip seal, which acts from the stationary hub of the annular disk against the rotating hub of the axially mobile displacement disk. The advantage here consists of the fact that high sliding velocities may be obtained at the radial lip seal, as the latter is located on the smallest possible diameter.

To rotate the two displacement disks a drive shaft with a replaceable toothed belt drive is located outside the displacement disks, wherein the belt pulleys are connected fixedly in rotation with the hubs of the displacement disks. This uncentered drive mode leaves the inner space of the displacement disks free and the medium being conveyed is able to flow out freely through a hollow journal.

BRIEF DESCRIPTION OF THE DRAWING

The drawing schematically shows an example of embodiment of the invention. In the drawing.

DETAILED DESCRIPTION OF A PREFERRED EMBODIMENT

Figure 1:
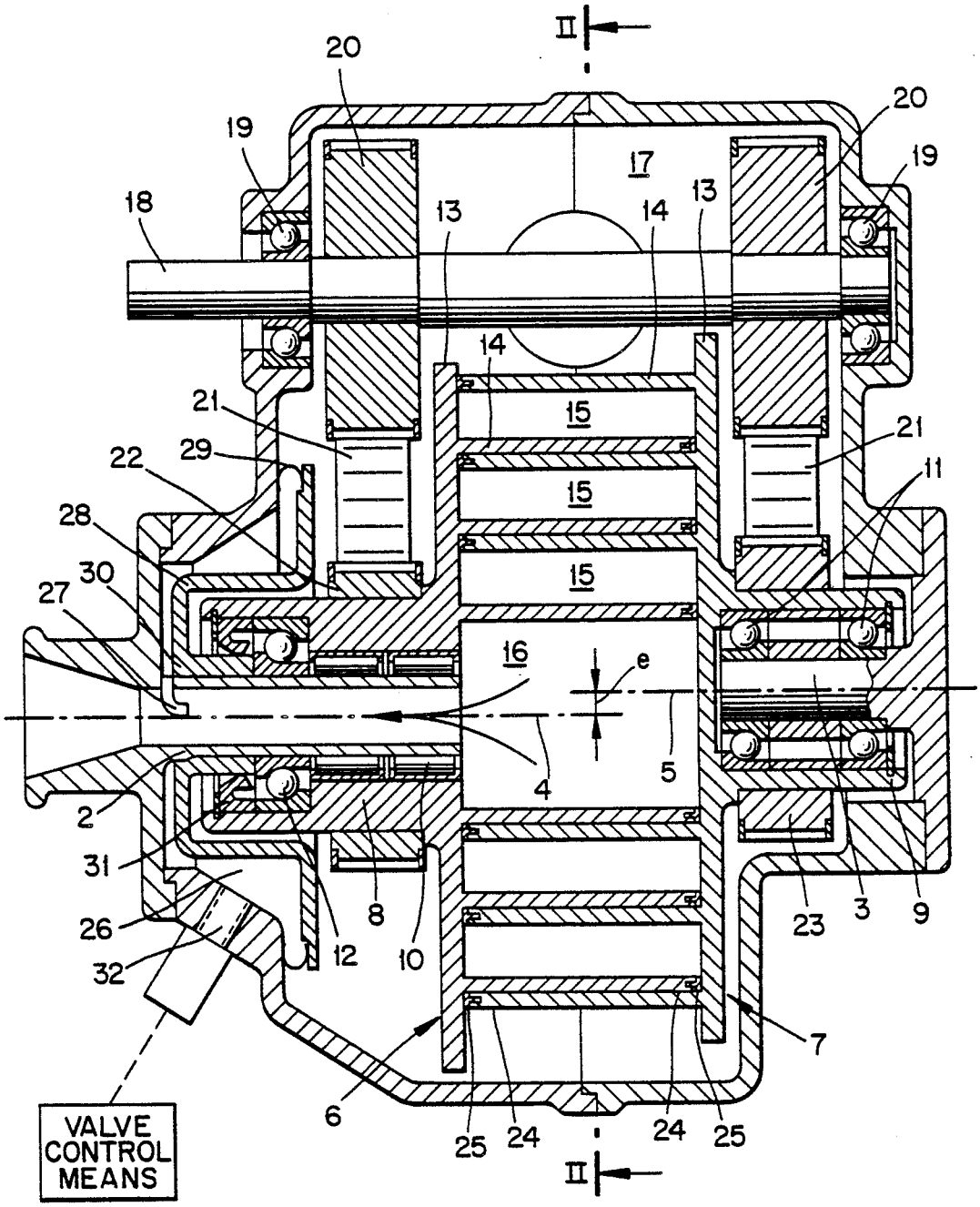
FIG. 1 is a view of a longitudinal section through a helical charger.

In the following description, only the configuration of the machine and the operation of the process necessary for an understanding of the invention is described. For an explanation of the mode of operation of the compressor, which is not an object of the present invention, reference is made to U.S. Pat. No. 3,600,114.

The two-speed, single stage machine is shown approximately in its actual size in the drawings. The direction of flow of the working medium is indicated by arrows.

In the figures, 1 designates a housing comprised of two halves. The two halves are joined together by means of fastening lugs, not shown, for the passage of screws. On either side of the housing, journals 2 and 3 are mounted in the housing halves. The journals 2, 3 project into the inside of the housing. The longitudinal axes 4 and 5, respectively, of the journals 2, 3 are mutually offset by the eccentricity e.

The rotating displacement disks 6 and 7 are set loosely on said journals. The hub 9 of the right hand displacement disk 7 is mounted by means of two ball bearings 11 on the journal 3 and is thus axially secured thereto. The left hand displacement disk 6 is axially displaceable. The hub 8 of disk 6 is loosely drawn onto the journal 2 by means of two needle bearings 10 that function as supports. In the area of said needle bearings the journal 2 is ground smoothly, as it forms the running surface for the needles. An additional axial bearing 12 is mounted adjacent the journal 2 so that forces may be transmitted to the hub 8.

Figure 2:
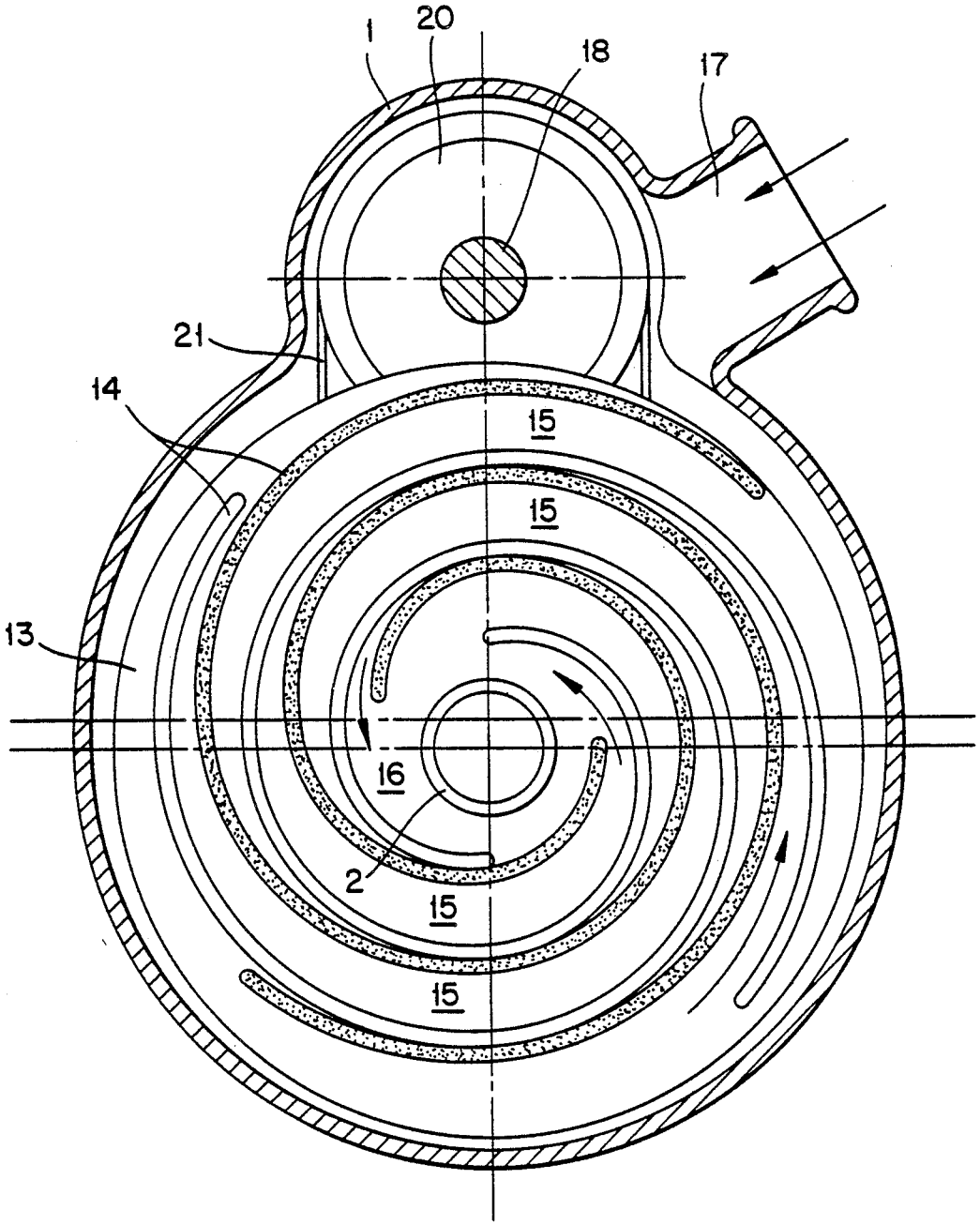
FIG. 2 a cross-sectional view taken along line II—II in FIG. 1.

The displacement disks 6 and 7 are symmetrical in their configuration. Each disk consists essentially of a flat plate 13, which disks in an assembled state are parallel to each other. The disks further comprise ribs 14, which ribs 14 are held perpendicularly to the plate 13. The ribs 14 are helical in their configuration (FIG. 2), i.e., they may either be conventional helices or may be comprised of a plurality of successive circular arcs.

In the embodiment shown in the drawings, the ribs 14 have an arc length of one-and-a-half turns, for which the machine is designated "single stage". Each plate 13 is equipped with two such ribs 14, said ribs being mutually offset by 180. This leads to the designation of "two-speed". In such two-speed machines, four parallel work spaces 15 are formed, representing the conveying space. During operation of the machine, the work spaces 15 open at a distance of ¼ turn against the outlet 16. At the outer diameter, the work spaces 15 open against the inlet 17, whereby they suction in fresh air.

The system is driven by a drive shaft 18, supported on ball bearings 19 in the housing 1 outside the displacement disks. On the shaft 18, belt pulleys 20 are mounted, which by means of toothed belts 21 drive belt pulleys 22 and 23, which are connected fixedly in rotation with the hubs 8 and 9 of the displacement disks.

During the rotating motion the work spaces 15 open against the inlet 17, from which they suction in fresh air. As the result of the multiple, alternating mutual approachment of the ribs 14, the sickle-shaped work spaces 15 are displaced by the helices from the inlet 17 in the direction of the outlet 16. The working medium conveyed in this manner is subsequently discharged from the charger through the hollow journal 2.

It is obvious that for an orderly operation, it is not only the radial seal between the ribs 14, i.e., the sealing of the work spaces 15 in the circumferential direction, that is important. The axial tightness of the conveying spaces 15 is also of importance. Accordingly, the ribs 14 must abut with their edges 24 against the plate 13 of the opposite displacement disk. This is achieved as a rule by sealing strips 25, which are placed in corresponding grooves in the edges 24 of the ribs. As the pressure increasing toward the inside of the helice tends to force the two displacement disks apart, counter measures must be taken.

Between the axially displaceable disk 6 and the wall of the housing a pressure chamber 26 is provided. The pressure chamber 26 is exposed to the pressure of the working medium in the outlet 16. For that purpose, the hollow journal 2 is connected through a bleed pipe 27 with the pressure chamber 26. The pressure in the chamber acts on an annular disk 28, which is fastened by means of a bellows 29 to the housing 1, by appropriate means in an airtight manner.

During a pressure initiated axial displacement, the annular disk 28 slides with its hub 30 on the journal 2. In the process, it displaces the adjacent inner cage of the axial bearing 12. On the balls of said bearing 12, the displaceable hub 8 of the displacement disk 6 is entrained until the ribs 14 abut against the opposite plates.

The rear side of the annular disk 28 facing the displacement disks is exposed to the pressure prevailing in the inlet 17, i.e., the atmospheric pressure. It may thus be seen that the mere dimensioning of the active annular disk surface provides a simple means to control the contact pressure of the ribs against the plates. However, in this case the inlet must be separated from the outlet, relative to pressure, as they communicate through the bearings 10 and 12. This separation is effected by means of a lip seal 31 acting between the stationary hub 30 of the annular disk 28 and the rotating hub 8 of the displacement disk 6. The seal 31 is advantageously installed in a rotating manner, so that its lip seals against the stationary hub of the annular disk on the smallest possible diameter.

For the de-aeration of the pressure chamber 26, a valve 32 is screwed into the housing wall. It may be actuated either manually, or automatically by means of an engine-specific or charger-specific parameter. When the valve 32 is opened, atmospheric pressure enters the pressure chamber 26 and the pressure is equalized on both sides of the annular disk 28. The drop in internal pressure in the pressure chamber 26 causes the operational unit of the displacement disk 6 with the hub 8, axial bearing 12, and annular disk 28 to move to the left, as seen in FIG. 1. As the sealing strips 25 are usually inserted fixedly into the grooves of the edges 24 (and are not spring supported), the axial sealing effect is eliminated by the slightest displacement, whereby the pressure buildup inside the helices and the conveying process is interrupted.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A rotating helical charger for compressible media, comprising:

a housing having an inlet and an outlet;

drive means;

two symmetrically constructed displacement disks located within said housing, said disks being rotated by said drive means;

journals in said housing on which said displacement disks are drawn loosely, wherein the longitudinal axes of said journals are offset relative to each other;

helical ribs provided on one side of each of said two displacement disks, which ribs engage each other to form a conveying space and with their free edges having means for forming a seal against the opposing displacement disk;

one of said displacement disks being axially movable on its journal;

means forming a pressure chamber having an annular disk disposed within said housing, said pressure chamber communicating with said outlet of the charger and capable of acting on the annular disk which is actively connected with the axially movable displacement disk in order to move the axially displacement disk toward the other of said two displacement disks; and valve means for selectively connecting and disconnecting the pressure chamber with the atmosphere.

2. The helical charger according to claim 1, further comprising a bellows in the internal space of the housing for sealing the annular disk on its outer circumference against the housing; wherein the inlet is separated from the outlet by a lip seal positioned between a stationary hub of the annular disk and a rotating hub of the axially movable displacement disk.

3. The helical charger according to claim 1, wherein, said drive means for the rotation of the two displacement disks includes a drive shaft with a replaceable toothed belt gear positioned outside the displacement disks and belt pulleys being connected fixedly in rotation with the displacement disks.

* * * * *